US006520298B1

(12) United States Patent
Meuters et al.

(10) Patent No.: US 6,520,298 B1
(45) Date of Patent: Feb. 18, 2003

(54) RAIL BRAKE, ESPECIALLY A HOLDING BRAKE

(75) Inventors: Gunter Meuters, Krefeld (DE); Holger Quast, Moers (DE)

(73) Assignee: Thyssen Krupp Automotive AG, Bochum (DE)

( * ) Notice: Subject to any disclaimer, the term of this patent is extended or adjusted under 35 U.S.C. 154(b) by 0 days.

(21) Appl. No.: 09/630,991

(22) PCT Filed: Feb. 24, 1999

(86) PCT No.: PCT/EP99/01193

§ 371 (c)(1),
(2), (4) Date: Aug. 2, 2000

(87) PCT Pub. No.: WO99/44876

PCT Pub. Date: Sep. 10, 1999

(30) Foreign Application Priority Data

| | | |
|---|---|---|
| Mar. 6, 1998 | (DE) | 199 09 614 |
| Apr. 28, 1998 | (DE) | 198 18 969 |
| Sep. 24, 1998 | (DE) | 198 43 735 |

(51) Int. Cl.[7] ..... B61K 7/02
(52) U.S. Cl. ..... 188/62; 104/26.2
(58) Field of Search ..... 188/41, 32, 38.5, 188/62, 63, 67, 265, 271; 104/162, 26.2

(56) References Cited

U.S. PATENT DOCUMENTS

| | | | | | |
|---|---|---|---|---|---|
| 3,040,676 | A | * | 6/1962 | Checkley et al. | 104/162 |
| 3,148,633 | A | * | 9/1964 | Bick et al. | 104/162 |
| 3,637,052 | A | * | 1/1972 | Bick | 188/62 |
| 4,535,872 | A | * | 8/1985 | Bick et al. | 188/62 |
| 4,739,863 | A | * | 4/1988 | Stauffer | 104/249 |

FOREIGN PATENT DOCUMENTS

| | | | | |
|---|---|---|---|---|
| DE | EP-0046199 | A1 | * | 2/1982 |
| DE | 3236340 | A1 | * | 4/1983 |
| DE | EP-0637535 | A | * | 7/1994 |
| DE | EP-0786391 | A2 | * | 7/1997 |
| GB | 2118914 | A | * | 11/1983 |

* cited by examiner

*Primary Examiner*—Pam Rodriguez
(74) *Attorney, Agent, or Firm*—Max Fogiel

(57) ABSTRACT

A railroad track brake in which a piston track brake is shifted out of an active state into an inactive state by a track-brake lowering device with a length of structural section extending along the piston track brake and having drag bars attached thereto while engaging the piston track brake. The active and inactive states are produced without contacting the housing of the piston track brake, and the braking process is free of acceleration forces. The drag bars contact the piston track brake only when it is in an inactive state to prevent acceleration forces.

22 Claims, 5 Drawing Sheets

RAIL BRAKE, ESPECIALLY A HOLDING BRAKE

BACKGROUND OF THE INVENTION

The present invention concerns a track brake, especially a grade-compensating track brake for braking railroad vehicles, with at least one piston track brake against the rail and with a device actuated by a shifting mechanism and shifting the piston track brake out of an active and into an inactive state.

Grade-compensating track brakes are employed when there is a grade in the train-assembly sidings in shunting yards that is too steep for the coasting resistance of the individual cars.

A car, decelerated by track brakes at the beginning of a train-assembly siding, will accelerate to unacceptable speeds and can inflict considerable damage on the other cars or on the freight as it strikes against them.

A track brake of the aforesaid genus is known from German 19 635 487. The piston track brake itself is described in German 3 031 173. The piston track brakes in the known track brakes are distributed along the rail and can pivot subject to a shifting mechanism between an active and an inactive state around an axis paralleling the rail. The piston track brake can be pivoted into an inactive state at any time, even when some car wheels are within a braking section. The piston track brakes, however, can only be shifted into the active state when no wheels are in a braking section. This feature prevents the piston track brakes from being forced against the wheels. Each braking section must accordingly also be monitored by track-switching sensors in the form of track circuits for example. This approach is expensive Embodiments are known in practice that include a pneumatic piston-and-cylinder mechanism paralleling a tube that travels back and forth along the piston track brake. The end of the pneumatic mechanism's piston is hooked and engages the head of the tube. A hydraulic piston-and-cylinder mechanism or small shifting mechanism can be employed instead of the pneumatic mechanism. Whatever version is employed, the hooked end of a piston draws the tube in or lowers it. Power can be supplied to the individual piston track brakes or to groups of ten for example thereof. This embodiment allows a piston track brake to shifted into an active or inactive state even when the wheels are within a braking section. There is, however, a drawback to this system in that it requires several components that must be mounted on the piston track brake's housing. These components must be able to accommodate the extremely high accelerating forces that occur when the wheels strike the heads of the piston tube. Impacts 1000 times the acceleration of gravity have been measured. Practice has demonstrated that such accelerations considerably increase wear and accordingly costs while severely limiting performance. This embodiment is accordingly not way-stable and is particularly impractical for rough railroading.

SUMMARY OF THE INVENTION

The object of the present invention is to improve a track brake of the aforesaid genus to the extent that the piston track brakes can be shifted out of the inactive and into the active state even when there are car wheels in the braking section while simultaneously improving overall performance and ensuring a way-stable and robust structure.

This object is attained in accordance with the present invention in a generic track brake in that the aforesaid track-brake shifting device is a track-brake lowering device with a length of structural section that extends along the piston track brakes and has drag bars attached to it that engage the piston track brakes. The track-brake lowering brake is on the same level as the head of the piston tube. The piston track brake itself does not need to be modified. The drag bars extend over the piston-tube heads and, when the track-brake lowering brake is actuated, force the piston tubes down against their inherent shock-absorption resilience until the heads assume a position wherein they are no longer impacted by the car wheels. In this state the track brake will be inactive and the railroad vehicle can pass over it unimpeded.

The length of structural section in one preferred embodiment of the present invention rotates around its longitudinal axis. The length of structural section can be round or polygonal. The shifting mechanism can preferably be a tubular motor. Such other mechanisms as a linear drive with a cable and deflection roller can also be employed to rotate the section between an active and an inactive state, into the active state subject to resilient shock-absorption forces on the drag bars when the linear drive releases the cable. To shift it into the inactive state, the section is rotated when the cable is shortened by the displacement of the linear drive. A chain drive with a motor accommodated in the rail as in an overhead door can also be employed.

The length of structural section and/or the motor in this preferred embodiment can be provided with bearing pins that rest in associated bearings. It is practical for the bearings to be mounted on angle irons secured to the rail and in particular to their webs. It is essential to the performance of the track brake that the drag bars be outside the space needed to control the vehicle while still engaging the piston-tube heads when the track-brake lowering brake is in the active state. Performance will also be improved if the end of the drag bars that engages the piston track brake is provided with a round-off that allows them to roll over the upper surface of the piston-tube heads as the length of structural section rotates.

It will be practical for the length of structural section to be located along with the drag bars between the middle of the rail and the piston track brake in the path of the piston tube as it rises.

The drag bars in a further embodiment of the present invention can be fastened to the length of structural section by threaded bolts and cup springs tensioned thereby. The advantage is that drag bars that are easy to replace will protect the shifting mechanism from impact. Such impacts occur when cars are being rolled over a braking-section while the track-brake lowering brake is active and the drag bars are being engaged in a half-way position by rapidly moving piston tubes. It is practical for the drag bars to be of hardened slab steel approximately 10–20 mm thick and approximately 70–120 mm wide. The bars should be approximately 100–200 mm long in order to overlap the piston-tube heads sufficiently when the distances between the piston track brakes vary considerably.

The length of structural section in the track-brake lowering brake can just as well rise as rotate. In this event, the length of structural section can be provided with upright guides and/or lifting mechanisms in the form of threaded shafts or hydraulic piston-and-cylinder mechanisms, allowing the section and its drag bars to raise and lower the piston tubes.

Adjustable limiting switches can also be employed to monitor and vary the active and inactive states of the piston track brake, along with a maintenance state.

It can also be of benefit for the length of structural section to telescope along the piston track-brake and/or for the drag bars to be tensioned on at any desired locations or at any desired intervals along it.

When a grade-compensating brake in accordance with the present invention is installed, bores can be drilled in the track web between the ties to accommodate the piston track brake and the angle irons in the track-brake lowering brake without taking the distances between ties into consideration. Once the piston track brake has been screwed on, the telescoping structural section can be screwed into place by extending it until its two angle irons are aligned with their bores. The drag bars can then be aligned and fastened to the section in accordance with the actual installed position of thr piston track brakes. Modifications in the superstructure of thr train-assembly siding to adapt it to the intervals between ties will not be necessary in accordance with the present invention. It is also possible in accordance with the present invention to employ a telescoping section by itself or, when a telescoping section is not employed, to tension the drag bars to the section at any desired points.

The telescoping section cam comprise two or more square or otherwise polygonal lengths, one sliding in and out of the other. It is important in this event to prevent the inner length from rotating inside the outer length. Bearing pins and bearings can be positioned at either head of the lengths and screwed to the angle irons. The telescoping section can easily be adjusted in length to conform to the varying distances of the screws that secure the angle irons before it is screwed tight.

The drag bars can preferably be tensioned to the structural section with U-shaped clamps that conform to its outer contour. The drag bars can be angled, one arm contacting the piston track brake's piston tube by way of a small roller. The other arm can constitute a base plate and rest against one side of the telescoping section. The edges of the base plate extend beyond the telescoping section to allow the open ends of the U-shaped clamps to be screwed to the base plate. The open ends of two of the U-shaped clamps that conform to the contour of the structural section can be threaded, allowing them to screw into the base plate and accordingly tension the drag bars at any desired points along the section. Piston track brakes installed at very different positions can accordingly be equalized without additional expenditure.

In one preferred embodiment of the present invention one or more shock-absorbing plates can be interposed between the drag bar's base plate and one side of the telescoping section, attenuating any impact stresses that may occur. The telescoping section can also be multiple-stage or be at each end of a length of structural section.

The advantages attained in accordance with the present invention will now be summarized. The piston track brakes can be employed either when they are forced down directly by a railroad-car wheel or when they cannot be shifted out of an inactive and into an active state and vice versa. When one piston track brake is prevented from automatically shifting its state by a wheel resting above it, the track-brake lowering brake can still be acuated, allowing all the other to shift into the active state. Since the drag bars and the length of structural section are located outside the space needed to control the car, they will not come into contact with the car's wheels. The braking section will not need to be monitored by rail-switching sensors.

BRIEF DESCRIPTION OF THE DRAWINGS

The present invention will now be specified with reference to the attached drawing, wherein.

DESCRIPTION OF THE PREFERRED EMBODIMENTS

Figure 1:
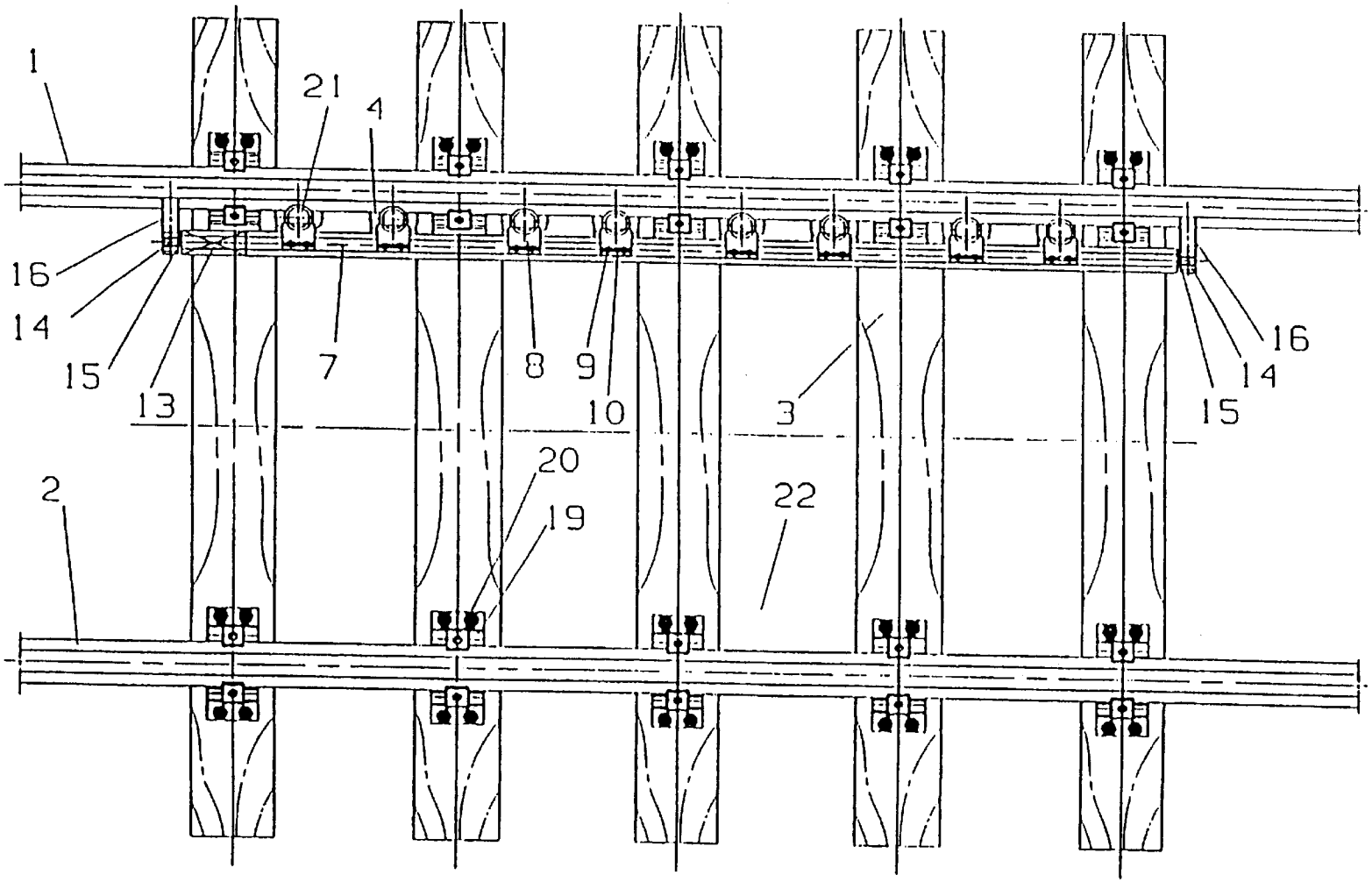
FIG. 1 is a top view of a train-assembly siding with a track brake resting against one rail.

The portion of a train-assembly siding illustrated in FIG. 1 is conventionally provided with rails 1 and 2 secured to ties 3 by ribbed plates 19 and hooked-head screws 20. Secured to the web 23 rail 1 within each tie coffer 22 by screws 24 are two piston track brakes 4 of a generally known construction. Practical grade-compensating brakes extend over three to five coffers 22.

The illustrated embodiment includes five occupied coffers 22. A rotating length of octagonal structural section 7 provided with drag bars 8 parallels rail 1.

Mounted on one end of structural section 7 is a bearing pin 15. At the other end is a tubular motor 13. Motor 13 is also provided with a bearing pin 15. Bearing pins 15 rest in rotating bearings 14. Bearings 14 are screwed or welded to angle irons 16. Angle irons 16 are screwed to web 23. It is of course also possible to support angle irons 16 against ties 3.

Figure 2:
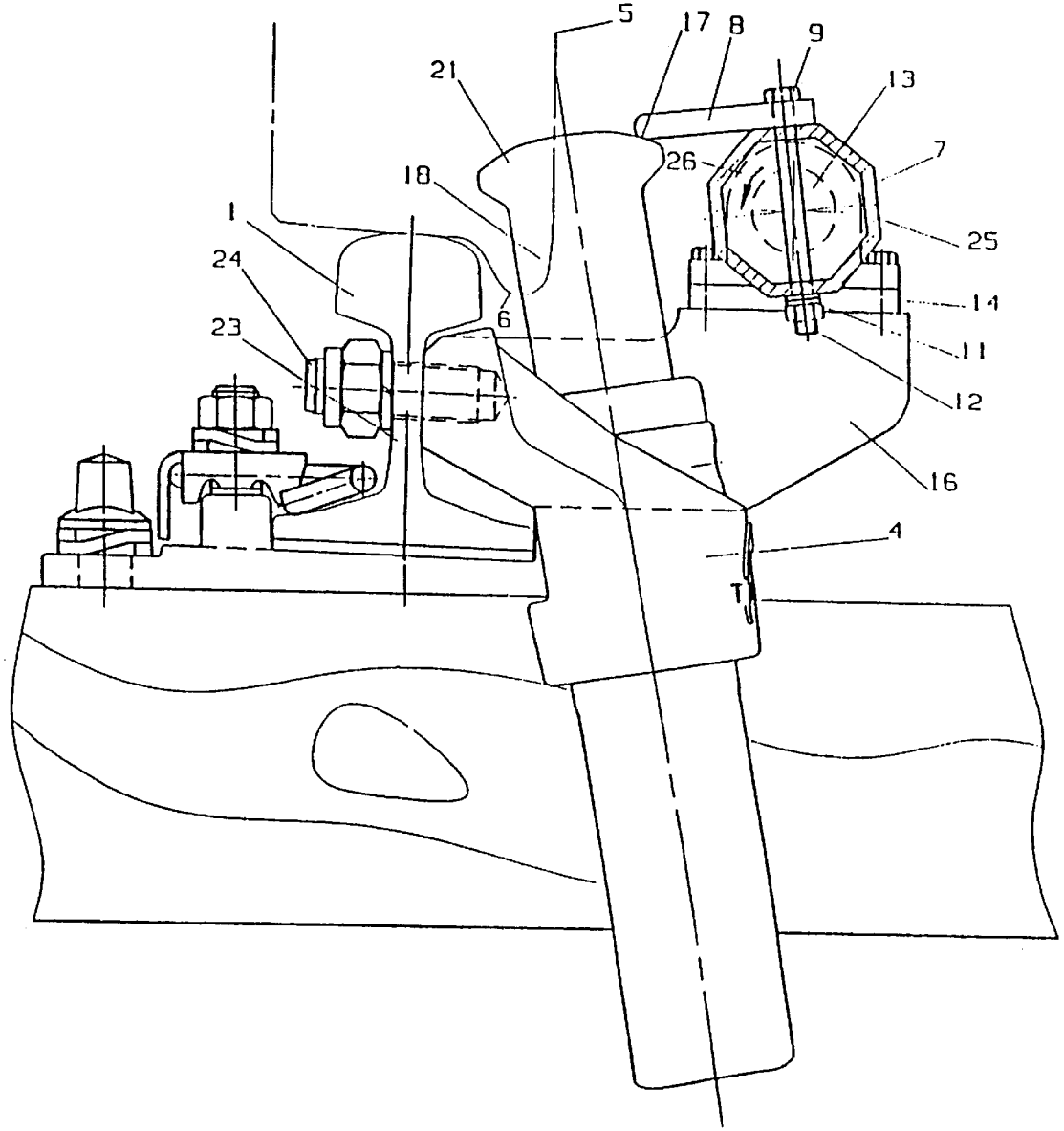
FIG. 2 is a schematic cross-section through the grade-compensating brake and its lowering device.

As will be evident from FIG. 2, drag bars 8 are screwed to one side 25 of drag bars 8 by two threaded bolts 9 each. Threaded bolts 9 are tensioned along with cup springs 11 between nuts 12 and structural section 7, allowing them to provide shock absorption in the event of sudden impact. Drag bars 8 are of hardened steel and are provided with a round-off 17 facing piston-tube head 21 that allows them to roll smoothly. Drag bars 8 are provided with slots 10 for bolts 9, allowing adjustment along rail 1 even after the track has been installed and, in the event of wear on drag bars 8, the establishment of a new point of contact, considerably extending the life of the bars.

The grade-compensating track brake is illustrated in its active state in FIG. 2, the wheel 5 and wheel flange 6 of an unillustrated railroad car, represented by broken lines, rolling over the head 21 of piston tube 18.

In this event, drag bars 8 and structural section 7 can offer no impediment to the car's motion.

Figure 3:
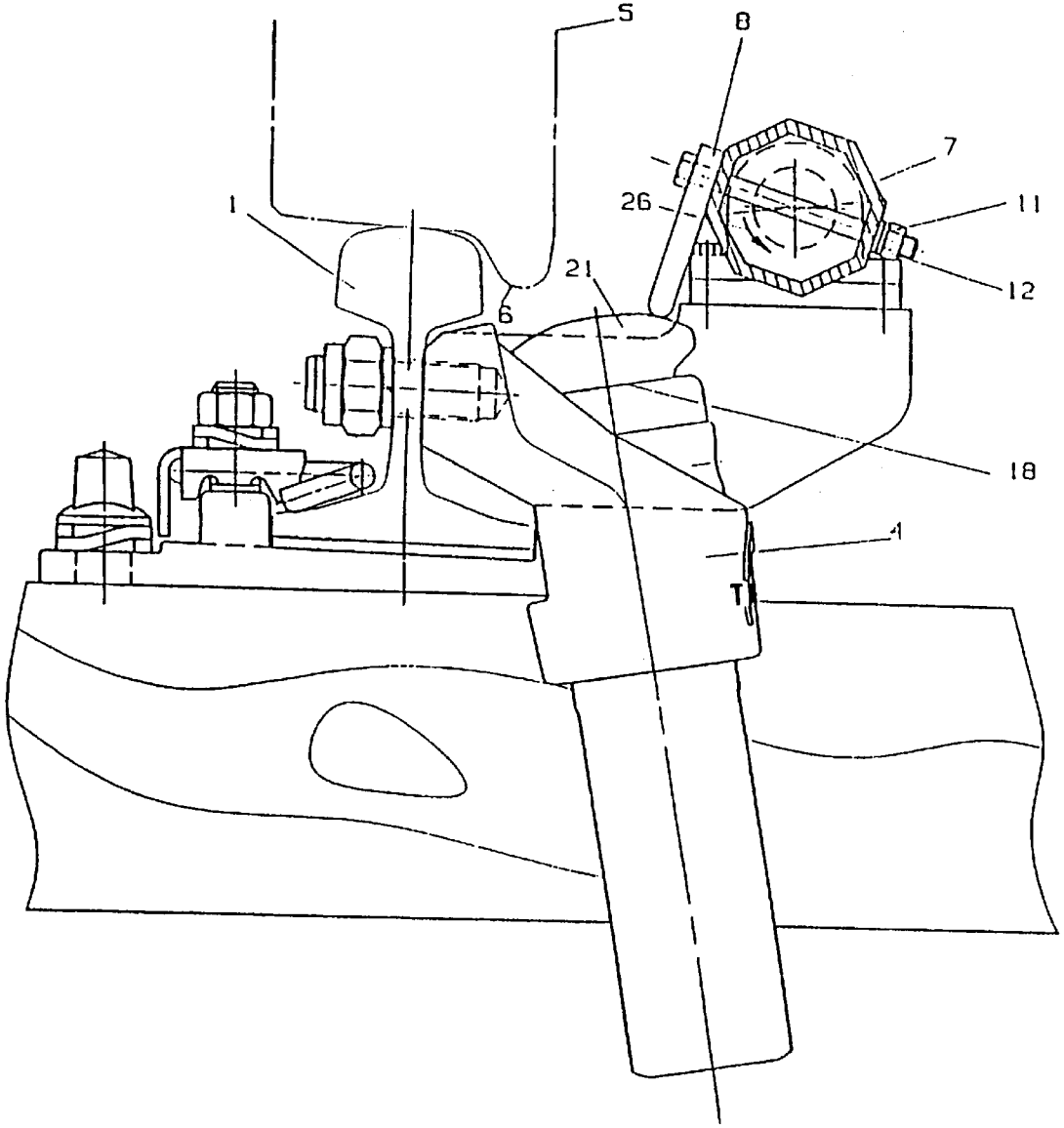
FIG. 3 illustrates the brake illustrated in FIG. 2 in another state.

To shift the grade-compensating brake to the inactive state illustrated in FIG. 3, structural section 7 and its drag bars 8 are rotated in direction 26 by motor 13, the bars dragging the longitudinally sliding piston tube 18 along. Wheel 5 and wheel flange, 6 can then travel over the track brake unimpeded. Unillustrated variable limiting switches regulate and monitor both states of piston track brake 4.

It will be practical for motor 13 to rotate only in direction 26. Rotation in the opposite direction is also possible, but it is electrically simpler for the motor to continue in the same direction when the track brake is shifted back out of the inactive state illustrated in FIG. 3 and into the active state illustrated in FIG. 2. Once piston-tube heads 21 have been released by drag bars 8, piston tubes 18 will slide out automatically subject to their interior shock absorbers, whereas structural section 7 will continue to rotate along with its drag bars 8 into the initial state illustrated in FIG. 2.

The brake can also be shifted into an unillustrated third state, the maintenance state, wherein piston-tube heads 21 are accessible, allowing piston tubes 18 to be extracted for servicing. The maintenance state is also monitored by a limiting switch and can be actuated when necessary.

Figure 4:
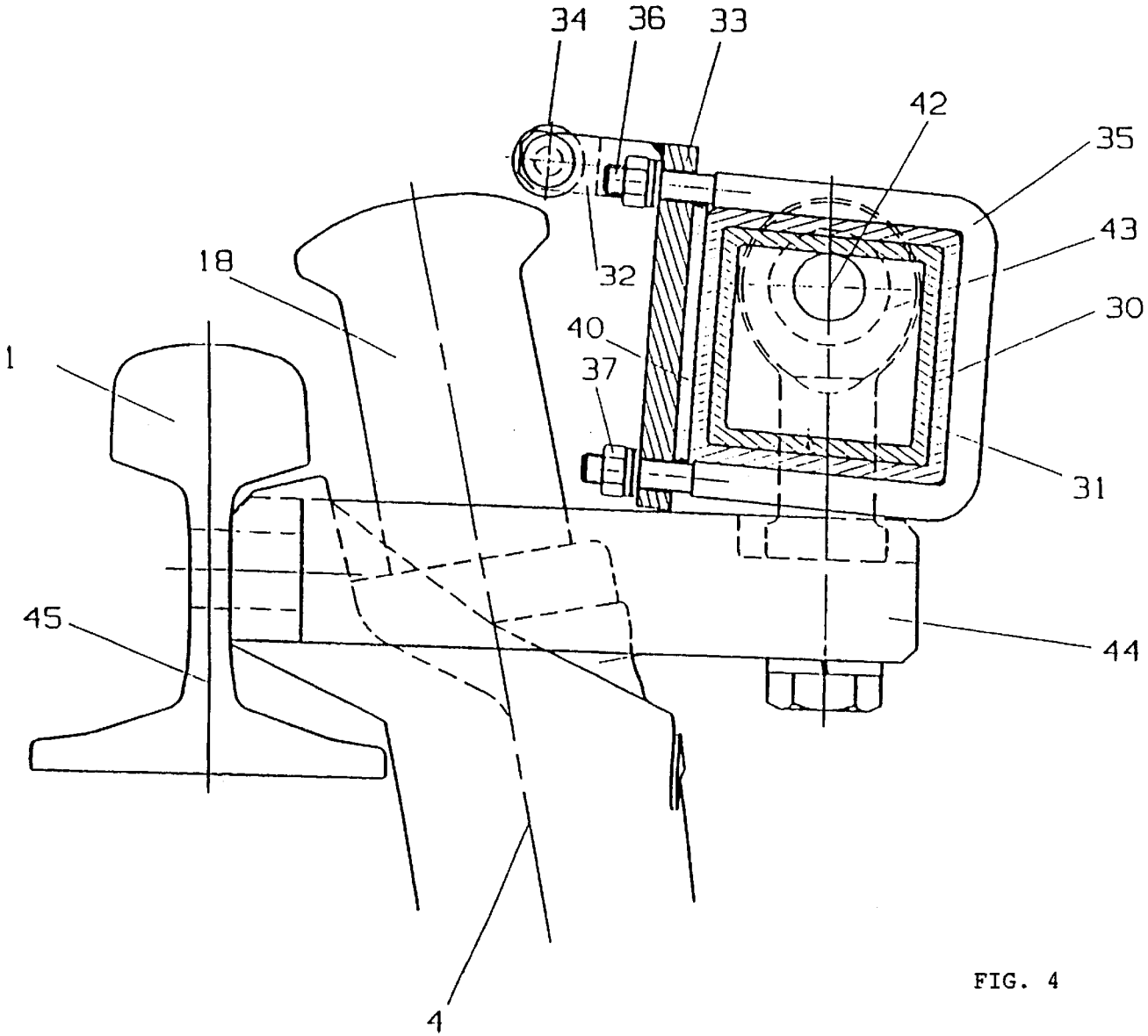
FIG. 4 is a schematic cross-section through the grade-compensating brake with a different type of track-brake lowering device along with the upper part of the piston track brake.
Figure 5:
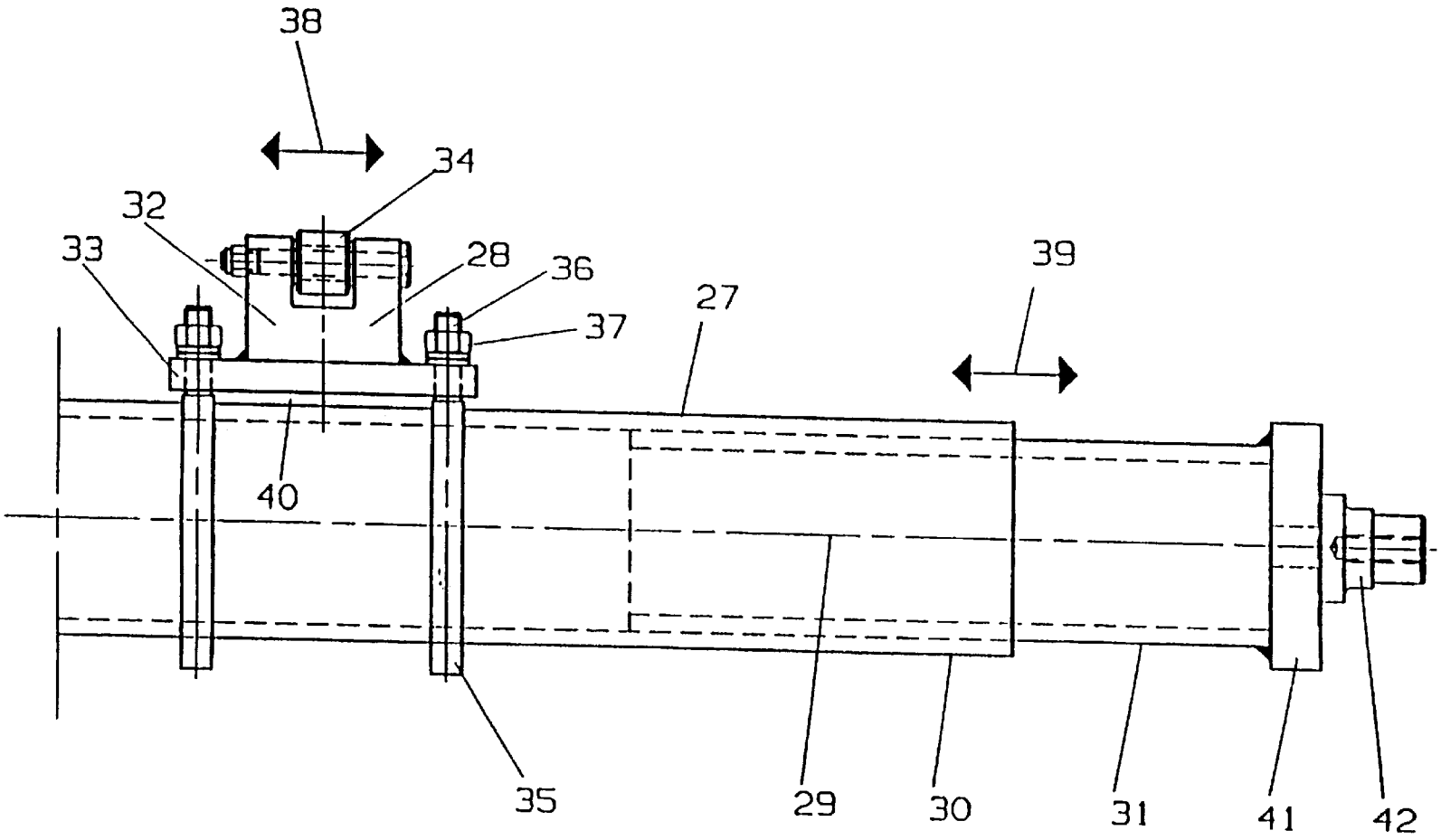
FIG. 5 is a top view of part of the telescoping length of structural section illustrated in FIG. 4 with a drag bar tensioned into position.

The drag bar 28 represented as tensioned against one side 27 of telescoping section 29 in FIGS. 4 and 5 is angled. As will be evident from FIG. 5, one arm 32 of drag bar 28 engages the piston tube 18 in piston track brake 4 by way of a small roller 34. The other, arm 33, of drag bar 28 serves as a base plate, allowing the component to be screwed to a C clamp 35 that accommodates telescoping section 29. Since the open ends of u-shaped clamps 35 are provided with threaded sections 36, the clamps can be appropriately positioned, and the tension needed to secure drag bar 28 against telescoping section 29 established in direction 38. Interposed between base-plate arm 33 and the side 27 of telescoping section 29 is a shock-absorbing plate 40 that accommodates any sudden impacts exerted on drag bar 28 by piston track brake 4.

The telescoping section 29 illustrated in FIG. 5 comprises two square tubes, a thicker tube 30 and a thinner tube 31, and can be considerably extended in direction 39 to span the many different interbore distances resulting from irregular C-clamp distribution. The bases of tubes 30 and 31 are closed by terminal plates 41 that constitute accommodations for bearing pins 42. Bearing pins 42 rest, as will be evident from FIG. 4, in a rotating bearing 43 and are screwed or welded to angle irons 44. The connection by way of screws is not illustrated. It is of course also possible for the angle irons 44 to rest against unillustrated railroad ties.

LIST OF COMPONENTS

1. rail
2. rail
3. tie
4. piston track brake
5. wheel
6. wheel flange
7. octagonal section
8. drag bar
9. screw
10. slot
11. cup spring
12. nut
13. tubular motor
14. [illegible]
15. bearing pin
16. angle iron
17. round-off
18. piston tube
19. ribbed plate
20. hook-headed screw
21. piston-tube head
22. coffer
23. web
24. threaded piston-track brake connection
25. side of octagonal section
26. direction of motion
27. side of telescoping section 29
28. drag bar
29. telescoping section
30. thicker tube
31. thnner tube
32. drag bar 28 arm
33. drag bar 28 base plate
34. roller
35. clamp
36. threaded section
37. nut
38. drag-bar motion
39. telescoping-section motion
40. shock-absorbing plate
41. head plate
42. bearing pin
43. bearing
44. angle iron
45. web

What is claimed is:

1. A track brake, especially a grade-compensating track brake for braking railroad vehicles, comprising: at least one piston track brake with a housing against a rail; means actuated by a shifting mechanism for shifting said piston track brake out of an active state and into an inactive state; said shifting mechanism comprising a track-brake lowering device with a length of structural section extending along the piston track brake and having drag bars attached to said structural section and engaging said piston track brake; said piston track brake remaining fixed to said rail and in the operating region of wheels of said railroad vehicles, said active and inactive states being carried out without contacting said housing of said piston track brake, the braking process being free of acceleration forces, said drag bars contacting said piston track brake only when said piston track brake is in an inactive state to prevent acceleration forces by not actuating said piston track brake in the inactive state, in the active state said piston track brake remaining in an operating region of said piston track brake and said drag bars sliding in a piston tube adjacent to a rear wheel for entering the active state also when the wheels are in the operative region of the piston track brake, so that said piston track brake can be shifted out of the inactive state and into the active state in a braking section even when car wheels are present in the braking section, the active and inactive state of said brake being attained by said drag bars shifting the piston tube vertically, said drag bars being rotatable.

2. Track brake as in claim 1, characterized in that shifting mechanism is a linear drive with a cable and deflection roller, rotating the structural section into an inactive state, and in that the structural section rotates into the active state subject to resilient shock-absorption forces.

3. Track brake as in claim 1, characterized in that the drag bars are tensioned on the length of structural section at any desired locations along it and/or that the length of structural section is a telescoping section.

4. Track brake as in claim 3, characterized by a shock-absorbing plate (40) between a base plate on the drag bar and one side of the telescoping section.

5. Track brake as in claim 3, characterized in that an arm of the drag bar that applies force to the piston tube is provided with a roller.

6. Track brake as in claim 3, characterized in that the telescoping section comprises two or more square or otherwise polygonal lengths, one sliding in and out of the other.

7. Track brake as in claim 1, characterized in that the drag bars are tensioned to the structural section with clamps.

8. Track brake as in claim 7, characterized in that the clamps are U-shaped.

9. Track brake as in claim 7, characterized in that the clamps conform to the outer contour of the telescoping section.

10. A track brake as defined in claim 1, wherein said structural section has a longitudinal axis, said structural section rotating about said longitudinal axis.

11. A track brake as defined in claim 1, wherein said structural section is round.

12. A track brake as defined in claim 1, wherein said shifting mechanism comprises a tubular motor.

13. A track brake as defined in claim 1, including bearing pins on said structural section and resting in associated bearings.

14. A track brake as defined in claim 1, wherein said structural section has upright guides for allowing said structural section and said drag bars to raise and lower a piston tube.

15. A track brake as defined in claim 1, including bearings mounted on angle irons secured to said rail.

16. A track brake as defined in claim 1, wherein said structural section is located along with said drag bars between the middle of said rail and said piston track brake and in the path of a piston tube as said tube rises.

17. A track brake as defined in claim 1, wherein said drag bars engage said piston track brake and have a rollover round-off.

18. A track brake as defined in claim 1, including threaded bolts and cup springs for fastening said drag bars to said structural section.

19. A track brake as defined in claim 1, including variable limiting switches monitoring and controlling active and inactive states of the piston track brake along with a maintenance state.

20. A track brake as defined in claim 1, wherein said structural section is polygonal.

21. A track brake as defined in claim 1, wherein said structural section has lifting means for allowing said structural section and said drag bars to raise and lower a piston tube.

22. A track brake, especially a grade-compensating track brake for braking railroad vehicles, comprising: at least one piston track brake with a housing against a rail; means actuated by a shifting mechanism for shifting said piston track brake out of an active state and into an inactive state; said shifting mechanism comprising a track-brake lowering device with a length of structural section extending along the piston track brake and having drag bars attached to said structural section and engaging said piston track brake; said piston track brake remaining fixed to said rail and in the operating region of wheels of said railroad vehicles, said active and inactive state being carried out without contacting said housing of said piston track brake, the braking process being free of acceleration forces, said drag bars contacting said piston track brake only when said piston track brake is in an inactive state to prevent acceleration forces by not actuating said piston track brake in the inactive state, in the active state said piston track brake remaining in an operating region of said piston track brake and said drag bars sliding in a piston tube adjacent to a rear wheel for entering the active state also when the wheels are in the operative region of the piston track brake, so that said piston track brake can be shifted out of the inactive state and into the active state in a braking section even when car wheels are present in the braking section; said structural section having a longitudinal axis, said structural section rotating about said longitudinal axis; said structural section being round; said shifting mechanism comprising a tubular motor; bearing pins on said structural section and resting in associated bearings; said structural section having upright guides for allowing said structural section and said drag bars to raise and lower a piston tube; bearings mounted on angle irons secured to said rail; said structural section being located along with said drag bars between the middle of said rail and said piston track brake and in the path of a piston tube as said tube rises; said drag bars having an end engaging said piston track brake and having a rollover round off; threaded bolts and cup springs for fastening said drag bars to said structural section; variable limiting switches monitoring and controlling active and inactive states of the piston track brake along with a maintenance state, the active and inactive state of said brake being attained by said drag bars shifting the piston tube vertically, said drag bars being rotatable.

* * * * *